US010247375B1

(12) United States Patent
Lu

(10) Patent No.: US 10,247,375 B1
(45) Date of Patent: Apr. 2, 2019

(54) ELECTRIC FIREPLACE HAVING SIMULATED DYNAMIC WALL

(71) Applicant: Dong Guan Song Wei Electric Technology Co., Ltd., Dongguan, Guangdong (CN)

(72) Inventor: Weilin Lu, Dongguan (CN)

(73) Assignee: DONG GUAN SONG WEI ELECTRIC TECHNOLOGY CO., LTD., Dongguan, Guangdong (CN)

( * ) Notice: Subject to any disclaimer, the term of this patent is extended or adjusted under 35 U.S.C. 154(b) by 0 days.

(21) Appl. No.: 16/016,673

(22) Filed: Jun. 25, 2018

(51) Int. Cl.

| | |
|---|---|
| ***F24B 1/18*** | (2006.01) |
| ***F21S 10/04*** | (2006.01) |
| ***F21V 23/00*** | (2015.01) |
| ***H05B 33/08*** | (2006.01) |
| *F21Y 115/10* | (2016.01) |

(52) U.S. Cl.
CPC ..... *F21S 10/043* (2013.01); *F21V 23/001* (2013.01); *F21V 23/006* (2013.01); *F24B 1/1808* (2013.01); *H05B 33/0851* (2013.01); *F21Y 2115/10* (2016.08)

(58) Field of Classification Search
CPC . F24C 7/004; F21S 10/04; G09F 19/12; A63J 5/023; F21W 2131/406
See application file for complete search history.

(56) References Cited

U.S. PATENT DOCUMENTS 9,188,345 B1 * 11/2015 Lu ..... F24C 7/004
9,599,346 B2 * 3/2017 Lu ..... F24C 7/004

* cited by examiner

*Primary Examiner* — Tracie Y Green
(74) *Attorney, Agent, or Firm* — Leong C. Lei

(57) ABSTRACT

An electric fireplace having a simulated dynamic wall includes a housing and a simulated charcoal. The housing has a combustion room therein. The simulated charcoal is placed inside the combustion room and located at a bottom of the combustion room. An inner wall of the housing is provided with simulated wall tiles. A top of the combustion room is provided with a ceiling lamp. A connecting wire of the ceiling lamp is connected to a main control board. The main control board is provided with a low-voltage DC stabilized power supply circuit, a main control unit, a light-emitting load, and a light signal feedback comparator capable of forming a signal feedback.

9 Claims, 5 Drawing Sheets

ELECTRIC FIREPLACE HAVING SIMULATED DYNAMIC WALL

BACKGROUND OF THE INVENTION

1. Field of the Invention

The present invention relates to an electric fireplace, and more particularly, to an electric fireplace having a simulated dynamic wall.

2. Description of the Prior Art

A conventional electric fireplace mainly comprises simulated firewood, a light source, and a planar imaging screen. The light source reflects the simulated flame on the planar imaging screen so that the planar imaging screen forms a simulated flame effect. The simulated firewood has a burning simulation effect. However, both the simulated flame effect and the simulated firewood are arranged at the bottom of the planar imaging screen. The other areas of the combustion room in the electric fireplace lack the corresponding burning effect, so the entire fireplace lacks a three-dimensional effect and thus the simulation effect is not good.

Chinese Patent Application No. 201420500018.3 discloses an electric fireplace with a ceiling lamp. Although the brightness of the electric fireplace is increased to some extent, the following drawbacks still exist:

1. The assembly of the ceiling lamp: The ceiling lamp has only one casing, and it is generally installed in the middle of the front of the product. The irradiation effect at two sides is poor. The practicality and application range is not strong enough.

2. Three light boards are assembled in one casing. The irradiation effect is poor and cannot be flexibly applied.

3. The light from the casing cannot be projected on the wall tiles behind the charcoal. The product is not new and creative.

4. The combination of a light source: The left and right sides and the bottom of the casing are formed with holes. The light source will produce bright spots. Long-term exposure of the bright spots will cause eye fatigue. Strong light projected on the wall behind the charcoal makes the flames less effective and less realistic.

5. The color of the ceiling lamp will not simulate the change of wall tiles. The light is monochrome (only warm white light), and the practicality is not strong.

6. The ceiling lamp cannot simulate a variety of colors in combination with the wall tiles, and it cannot form a dynamic real-time change with the wall tiles. It cannot simulate the changing wall in a burning state.

Chinese Patent Application No. 201520498850.9 discloses an electric fireplace control system capable of adjusting light. Although the brightness of the electric fireplace is adjustable, it still has the following drawbacks:

1. This patent is generally applied to adjust the brightness of the flame of the electric fireplace (adjusting the brightness of the wheel reflector light source). The application range is generally at the bottom of the electric fireplace.

2. The electric fireplace is generally formed by the combination of flame viewing and heating, so the technical feature of this patent can only be applied to the formation of flames and cannot be applied to the load installed at the top.

3. The light adjustment of this patent is adjusted by a potentiometer to control the conduction angle of a thyristor and generally controls the high-voltage light bulb, not the dynamic gradient effect by the IC's internal light simulation program. The practicality is not good. It cannot simulate a variety of light color changes and cannot be combined with the surfaces of wall tiles to form a dynamic changeable wall.

4. The light adjustment module of this patent refers to a combination of a thyristor and a potentiometer. The strength of the light is not controlled by a microcontroller.

The innovation of the above two patents cannot form a variety of colors on the surfaces of the wall tiles, cannot form a dynamic change with the wall tiles, and cannot cooperate with the charcoal in the combustion room, the wall tiles and the flame to create a realistic dynamic wall change effect.

SUMMARY OF THE INVENTION

In view of the shortcomings of the prior art, the primary object of the present invention is to provide an electric fireplace having a simulated dynamic wall. The electric fireplace utilizes a ceiling light to project changeable light on simulated wall tiles of a combustion room so as to have a realistic dynamic burning change. The combustion room forms a more realistic landscape in order to overcome the deficiencies of the prior art.

In order to achieve the aforesaid object, the present invention adopts the following technical solutions:

An electric fireplace having a simulated dynamic wall comprises a housing and a simulated charcoal. The housing has a combustion room therein. The simulated charcoal is placed inside the combustion room and located at a bottom of the combustion room. An inner wall of the housing is provided with simulated wall tiles. A top of the combustion room is provided with a ceiling lamp. Light emitted from the ceiling lamp is projected on the simulated wall tiles. A connecting wire of the ceiling lamp is connected to a main control board. The main control board is provided with a low-voltage DC stabilized power supply circuit for providing a DC power source, a main control unit for implementing light change control, a driver or drive IC for performing light adjustment according to the main control unit, a light-emitting load, and a light signal feedback comparator capable of forming a signal feedback. A first branch of the low-voltage DC stabilized power circuit directly supplies power to the light-emitting load. A second branch of the low-voltage DC stabilized power circuit is connected with the main control unit, the driver or drive IC and the light-emitting load in sequence so that a control signal that can be dynamically changed is transmitted to the ceiling lamp. The light signal feedback comparator is connected in series between the light-emitting load and the main control unit to form a feedback control loop. During operation, a gradation signal output from the main control unit is transmitted to an input control pin of the driver or drive IC to connect or disconnect the driver or drive IC. The ceiling lamp is controlled to be switched on or off, or the light slowly fades between lighting and extinguishing. A light change signal is fed back to the main control unit so that the main control unit intelligently adjusts a conversion speed of the gradation signal.

Compared with the prior art, the present invention has obvious advantages and beneficial effects. Specifically, as can be seen from the above technical solutions, a ceiling lamp is provided above a combustion room of a conventional electric fireplace. The ceiling lamp can project changeable light on simulated wall tiles on the left and side sides or the back side behind the simulated charcoal of the combustion room to simulate the change of the color of the flame to form a realistic burning effect of the simulated wall tiles. The combustion room forms a more realistic landscape to enhance the market competition value of the electric fireplace product.

DETAILED DESCRIPTION OF THE PREFERRED EMBODIMENTS

Figure 1:
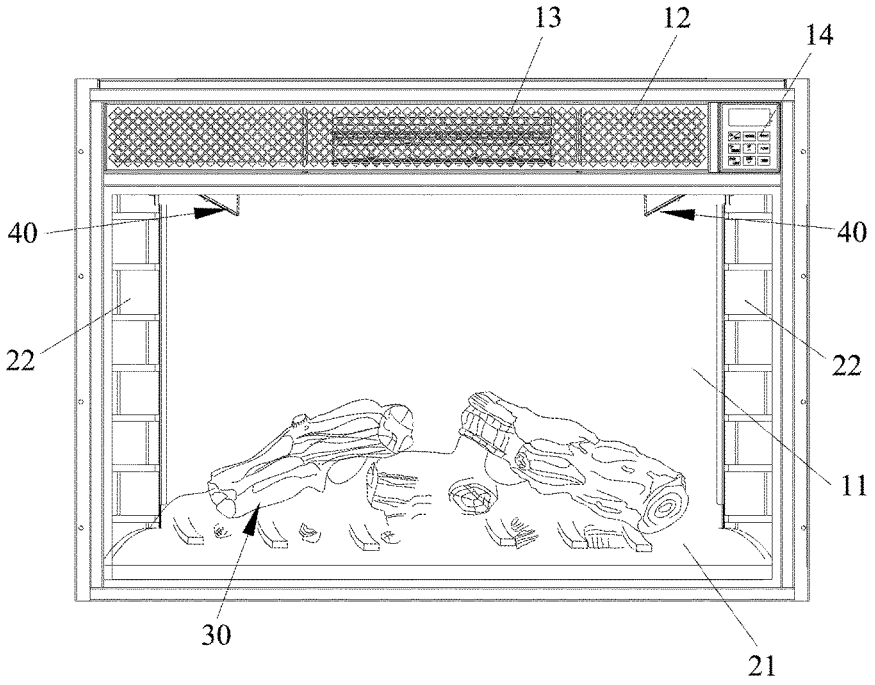
FIG. 1 is a front view in accordance with a first embodiment of the present invention.
Figure 2:
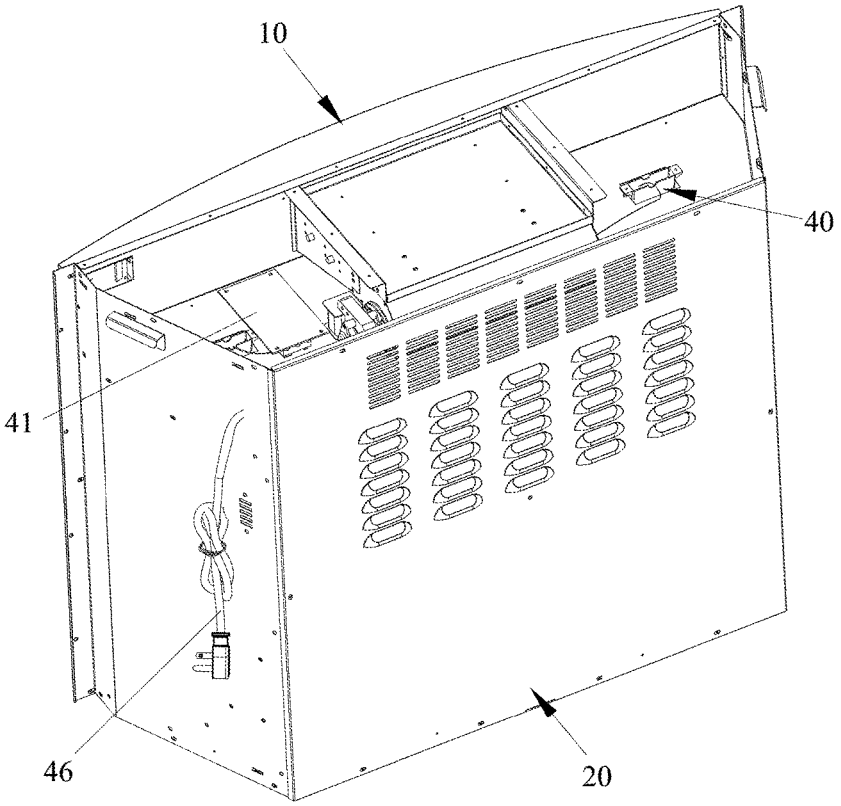
FIG. 2 is a rear view in accordance with the first embodiment of the present invention.

Referring to FIG. 1 to FIG. 4, an electric fireplace having a simulated dynamic wall in accordance with a preferred embodiment of the present invention comprises a panel 10, a housing 20, a simulated charcoal 30, and a ceiling lamp 40. The panel 10 is disposed at the opening of a combustion room 21. The panel 10 and the housing 20 surround the combustion room 21. The simulated charcoal 30 is placed inside the combustion room 21 and located at the bottom of the combustion room 21. The ceiling lamp 40 is installed at the top of the combustion room 21. The ceiling lamp 40 can project changeable light to the combustion room 21 and the inner wall of the combustion room 21 to form a more realistic charcoal burning scene.

A connecting wire 45 of the ceiling lamp 40 is connected to a main control board 41. The main control board 41 transmits a control signal that can be dynamically changed to the ceiling lamp 40, and then the ceiling lamp 40 project the changeable light on the inner wall of the housing 20. The main control board 41 is provided with a low-voltage DC stabilized power supply circuit 411 for providing a DC power source, a main control unit 412 for implementing light change control, a driver or drive IC 413 for performing light adjustment according to the main control unit, a light-emitting load 414, and a light signal feedback comparator 415 capable of forming a signal feedback. A first branch of the low-voltage DC stabilized power circuit 411 directly supplies power to the light-emitting load 414. A second branch of the low-voltage DC stabilized power circuit 411 is connected with the main control unit 412, the driver or drive IC 413 and the light-emitting load 414 in sequence, and a control signal that can be dynamically changed is transmitted to the ceiling lamp 40. The light signal feedback comparator 415 is connected in series between the light-emitting load 414 and the main control unit 412 to form a feedback control loop. During operation, a gradation signal output from the main control unit 412 is transmitted to an input control pin of the driver or drive IC 413 to connect or disconnect the driver or drive IC. The ceiling lamp 40 is controlled to be switched on or off, or the light slowly fades between lighting and extinguishing. The light change signal is fed back to the main control unit 412 so that the main control unit intelligently adjusts the conversion speed of the gradation signal.

Figure 3:
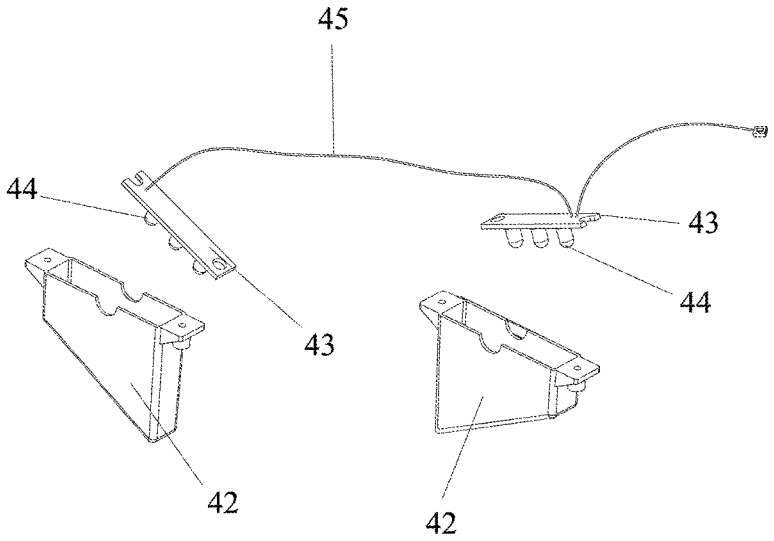
FIG. 3 is an exploded view of the ceiling lamp in accordance with the first embodiment of the present invention.
Figure 4:
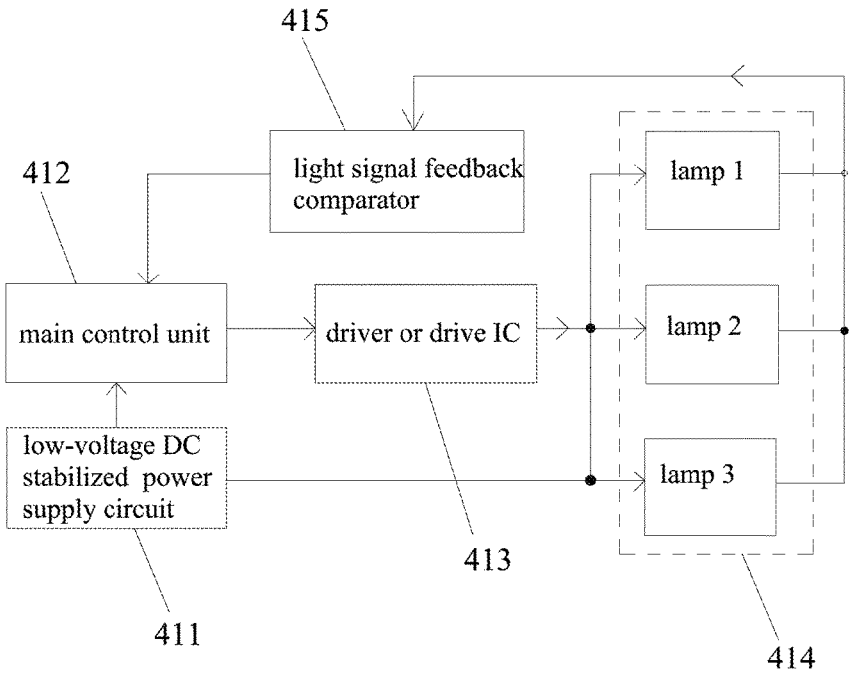
FIG. 4 is a block diagram of the circuit control in accordance with the first embodiment of the present invention.

As shown in FIG. 3, the ceiling lamp 40 includes a lamp casing 42, a lamp board 43, a plurality of light emitting diodes 44, and a connecting wire 45. The light emitting diodes 44 are welded and fixed on the lamp board 43. The lamp board 43 is mounted to the light casing 42. The connecting wire 45 is electrically connected with the light emitting diodes 44 through the light board 43. The number of the ceiling lamps 40 is two or more, such as three or four. In this way, multiple ceiling lamps can be set individually and spaced a predetermined distance apart from each other, so that the brightness emitted from the ceiling lamps can be uniform and projected on different walls. This situation will not happen: a portion of the combustion room is brighter, and the other portion is darker. Preferably, the electric fireplace is provided with two ceiling lamps 40. The two ceiling lamps 40 are connected in series with the connecting wire 45 and mounted at the left and right sides of the top plate of the housing 20, respectively. The lamp casings 42 of the two ceiling lamps 40 have a plurality of light projection holes. The light projection holes face the left side, the right side, or the back side of the housing 20, so that the changeable light of the LEDs is projected from the light projection holes to the wall surface, not to the front of the electric fireplace. The light of the entire combustion chamber won't directly project on the user, which can protect the user's eyes from fatigue after long-term viewing.

The number of the LEDs 44 may be changed as needed, such as three, a red LED, a green LED and a blue LED. The LEDs may be a combination of other colors. The LEDs are mounted to the light board 43 in a plug-in or surface-mount manner. The LEDs 44 of three colors may be combined in a blending light manner to have multiple colors, for example, a combination of red, orange, yellow, green and blue, so that the combustion room may be in various colors according to the change of brightness and darkness of the flame, not only having monotonous warm white light but do having the dynamic simulation effect of the flame.

Figure 5:
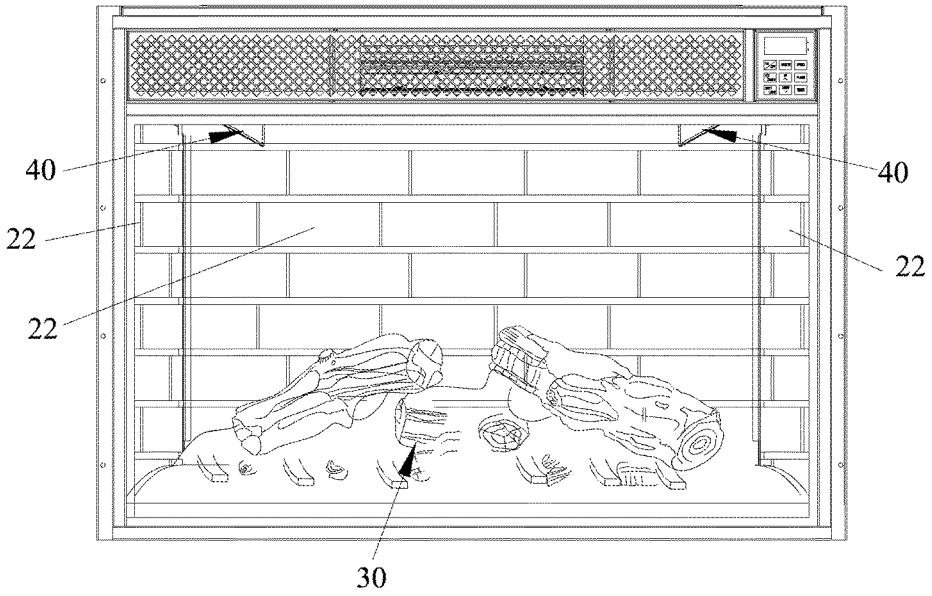
FIG. 5 is a front view in accordance with a second embodiment of the present invention.

In order to make the shape of the electric fireplace more similar to the traditional fireplace, the left and right sides of the inner wall of the housing 20 are provided with simulated wall tiles 22 (see FIG. 1). In another embodiment, the left and right sides and the back side of the inner wall of the housing 20 are provided with simulated wall tiles 22 (see FIG. 5). The simulated wall tiles 22 are made of a resin, blister, plastic, sticker or acrylic material. In this way, after the electric fireplace is lighted, the simulated charcoal will have a burning sense. The ceiling lamp 40 is used to project the changeable light on the simulated wall tiles 22, so that the sight of the wall tiles will gradually disappear, or gradually change or fade, enabling the surface of the wall tiles to have a realistic effect of changing the flame.

The housing 20 is a trapezoidal structure or a symmetrical structure that has a wide front and a narrow rear, so that the whole fireplace has a certain depth. On the one hand, the required devices (such as a heater, a spotlight, an electric motor, a light projection board, and a simulated charcoal 30, etc.) can be provided. On the other hand, it can show the original appearance of the fireplace and give people a real and intimate feeling. In this embodiment, the panel 10 is a curved or planar structure with a transparent viewing window 11, which makes the electric fireplace more plump and has a wider front view and is more natural. The top of the panel 10 is provided with a meshed panel 12. The meshed panel 12 has an air outlet 13. The meshed panel 12 is used for decoration and blocking dust. The air outlet 13 is embedded inside the meshed panel 12 in a hidden manner, not exposed. The appearance is clean and beautiful. In addition, a control button panel 14 is provided at a corner of the panel 10 to control the use of the entire electric fireplace and perform mode selection and the like. In another embodiment, the electric fireplace doesn't have the panel 10 and the housing 20, and it can be directly made into a planar structure with wall tiles at two sides thereof.

The working principle of the electric fireplace of the present invention is described below. The ceiling lamp 40 is installed on the top of the housing 20 and located above the combustion room 21 to project light on the surfaces of the left and right wall tiles or the surfaces of the wall tiles behind the simulated charcoal. The LEDs 44 on the light board 43 are controlled by the CPU program of the main control board 41. The light of the ceiling lamp 40 is projected on the simulated wall tiles to simulate the change of the color of the flame for forming a realistic dynamic burning effect. The power input wire of the ceiling lamp 40 is connected to the main control board 41. The main control board 41 is connected to a power wire 46 to provide power for the product. The main control board 41 is installed inside the housing. The simulated wall tiles are installed on the two sides of the inner wall of the housing or the rear wall behind the simulated charcoal to form the combustion room 21 with the simulated charcoal. When the light simulating the flame change is projected on the surfaces of the simulated wall tiles, the surfaces of the wall tiles will produce realistic dynamic wall. The combustion room forms a more realistic landscape to enhance the market competition value of the electric fireplace product.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. An electric fireplace having a simulated dynamic wall, comprising a housing and a simulated charcoal, the housing having a combustion room therein, the simulated charcoal being placed inside the combustion room and located at a bottom of the combustion room, characterized by: an inner wall of the housing being provided with simulated wall tiles; a top of the combustion room being provided with a ceiling lamp, light emitted from the ceiling lamp being projected on the simulated wall tiles; a connecting wire of the ceiling lamp being connected to a main control board, the main control board being provided with a low-voltage DC stabilized power supply circuit for providing a DC power source, a main control unit for implementing light change control, a driver or drive IC for performing light adjustment according to the main control unit, a light-emitting load, and a light signal feedback comparator capable of forming a signal feedback; a first branch of the low-voltage DC stabilized power circuit directly supplying power to the light-emitting load, a second branch of the low-voltage DC stabilized power circuit being connected with the main control unit, the driver or drive IC and the light-emitting load in sequence so that a control signal that can be dynamically changed is transmitted to the ceiling lamp, the light signal feedback comparator being connected in series between the light-emitting load and the main control unit to form a feedback control loop; wherein, during operation, a gradation signal output from the main control unit is transmitted to an input control pin of the driver or drive IC to connect or disconnect the driver or drive IC, the ceiling lamp is controlled to be switched on or off, or the light slowly fades between lighting and extinguishing, a light change signal is fed back to the main control unit so that the main control unit intelligently adjusts a conversion speed of the gradation signal.

2. The electric fireplace as claimed in claim 1, wherein the ceiling lamp includes a lamp casing, a lamp board, a plurality of light emitting diodes and the connecting wire, the light emitting diodes are welded and fixed on the lamp board, the lamp board is mounted to the light casing, and the connecting wire is electrically connected with the light emitting diodes through the light board.

3. The electric fireplace as claimed in claim 2, wherein the ceiling lamp includes two or more ceiling lamps, the connecting wire is connected in series between the ceiling lamps, the ceiling lamps are mounted at left and right sides of a top plate of the housing respectively, the lamp casings of the ceiling lamps have a plurality of light projection holes, the light projections holes face a left side, a right side, or a back side of the housing for projecting the light on the simulated wall tiles.

4. The electric fireplace as claimed in claim 2, wherein the light emitting diodes of the ceiling lamp are monochrome or colorful, and the light emitting diodes are mounted to the light board in a plug-in or surface-mount manner.

5. The electric fireplace as claimed in claim 1, wherein the simulated wall tiles are made of a resin, blister, plastic, sticker or acrylic material.

6. The electric fireplace as claimed in claim 1, wherein the housing is a trapezoidal structure or a symmetrical structure that has a wide front and a narrow rear.

7. The electric fireplace as claimed in claim 1, wherein left and right sides of an inner wall of the housing are provided with the simulated wall tiles, or left and right sides and a back side of an inner wall of the housing are provided with the simulated wall tiles.

8. The electric fireplace as claimed in claim 1, wherein a front of the housing is provided with a panel, and the panel is a curved or planar structure with a transparent viewing window.

9. The electric fireplace as claimed in claim 8, wherein a top of the panel is provided with a meshed panel, the meshed panel has an air outlet, and a control button panel is provided at a corner of the panel.

* * * * *